US011217388B2

(12) United States Patent
Itani et al.

(10) Patent No.: US 11,217,388 B2
(45) Date of Patent: Jan. 4, 2022

(54) MULTILAYER INDUCTOR MANUFACTURING METHOD AND MULTILAYER INDUCTOR

(71) Applicant: Murata Manufacturing Co., Ltd., Kyoto-fu (JP)

(72) Inventors: Yasuhiro Itani, Nagaokakyo (JP); Hiroki Hashimoto, Nagaokakyo (JP); Masayuki Oishi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 411 days.

(21) Appl. No.: 16/006,592

(22) Filed: Jun. 12, 2018

(65) Prior Publication Data

US 2018/0374636 A1 Dec. 27, 2018

(30) Foreign Application Priority Data

Jun. 22, 2017 (JP) ..... JP2017-122089

(51) Int. Cl.
*H01F 17/00* (2006.01)
*H01F 41/04* (2006.01)
(Continued)

(52) U.S. Cl.
CPC ..... *H01F 41/041* (2013.01); *H01F 17/0013* (2013.01); *H01F 17/0033* (2013.01);
(Continued)

(58) Field of Classification Search
CPC ..... H01F 17/0013; H01F 41/041
See application file for complete search history.

(56) References Cited

U.S. PATENT DOCUMENTS 6,603,380 B2 * 8/2003 Tokuda ..... H01F 41/043 336/200
2003/0164533 A1 * 9/2003 Tada ..... H01F 17/0006 257/531
(Continued)

FOREIGN PATENT DOCUMENTS

JP 2005159301 A * 6/2005
JP 2005294725 A 10/2005
(Continued)

OTHER PUBLICATIONS

An Office Action mailed by the China National Intellectual Property Administration dated Dec. 30, 2019, which corresponds to Chinese Patent Application No. 201810642827.0 and is related to U.S. Appl. No. 16/006,592 with English language translation.
(Continued)

*Primary Examiner* — Elvin G Enad
*Assistant Examiner* — Malcolm Barnes
(74) *Attorney, Agent, or Firm* — Studebaker & Brackett PC

(57) ABSTRACT

A multilayer inductor manufacturing method includes stacking a first coil conductor layer on a first magnetic layer; stacking a first burn-away material on side surfaces of the first coil conductor layer; stacking a second magnetic layer on the first burn-away material and first magnetic layer; stacking a second burn-away material on the second magnetic layer laterally outside an upper surface of the first coil conductor layer; stacking a second coil conductor layer on the upper surface of the first coil conductor layer and second burn-away material; stacking a third burn-away material on side surfaces and an upper surface of the second coil conductor layer; stacking a third magnetic layer on side surfaces of the third burn-away material and the second magnetic layer; stacking a fourth magnetic layer on the third burn-away material and the third magnetic layer; and burn-
(Continued)

ing away the first, second, and third burn-away materials via firing.

3 Claims, 10 Drawing Sheets

(51) Int. Cl.
*H01F 27/24* (2006.01)
*H01F 27/28* (2006.01)

(52) U.S. Cl.
CPC ..... *H01F 27/24* (2013.01); *H01F 27/2804* (2013.01); *H01F 41/046* (2013.01); *H01F 2017/0066* (2013.01); *H01F 2017/0073* (2013.01); *H01F 2027/2809* (2013.01)

(56) References Cited

U.S. PATENT DOCUMENTS

2005/0037183 A1* 2/2005 Hasegawa ..... H01F 17/0013 428/209
2011/0100527 A1* 5/2011 Tatsukawa ..... H01F 17/0013 156/89.12
2011/0310579 A1* 12/2011 Smeys ..... H01F 17/04 361/782
2012/0326827 A1* 12/2012 Nanjyo ..... H05K 1/165 336/200
2014/0306792 A1* 10/2014 Yoneda ..... H01F 17/0013 336/200
2015/0145628 A1* 5/2015 Kim ..... H01F 5/00 336/137
2017/0103842 A1* 4/2017 Nagai ..... H01F 3/14
2017/0294262 A1* 10/2017 Lee ..... H01F 27/2804
2017/0330674 A1* 11/2017 Lee ..... H01F 5/00
2018/0061555 A1* 3/2018 Jang ..... H01F 41/042
2018/0286562 A1* 10/2018 We ..... H01F 27/292
2020/0090854 A1* 3/2020 Schumann ..... G06K 19/07783

FOREIGN PATENT DOCUMENTS

JP 2009-117664 A 5/2009
JP 2016015370 A 1/2016
JP 2017073494 A 4/2017

OTHER PUBLICATIONS

An Office Action mailed by the Korean Intellectual Property Office dated Jul. 22, 2019, which corresponds to Korean Patent Application No. 10-2018-0070211 and is related to U.S. Appl. No. 16/006,592 with English language translation.

* cited by examiner

MULTILAYER INDUCTOR MANUFACTURING METHOD AND MULTILAYER INDUCTOR

CROSS-REFERENCE TO RELATED APPLICATION

This application claims benefit of priority to Japanese Patent Application No. 2017-122089, filed Jun. 22, 2017, the entire content of which is incorporated herein by reference.

BACKGROUND

Technical Field

The present disclosure relates to a multilayer inductor manufacturing method and to a multilayer inductor.

Background Art

Heretofore, a multilayer inductor has been disclosed in Japanese Unexamined Patent Application Publication No. 2009-117664. This multilayer inductor includes a multilayer body, which includes a plurality of magnetic layers, and a plurality of coil conductor layers that are provided inside the multilayer body.

When this multilayer inductor is manufactured, a first coil conductor layer is formed on a green sheet, and then a first magnetic layer is formed on the green sheet so as to cover end portions of the first coil conductor layer in a width direction. After that, a second coil conductor layer is formed on the first coil conductor layer, and then a second magnetic layer is formed on the first magnetic layer so as to cover end portions of the second coil conductor layer in the width direction. The multilayer inductor is manufactured by repeating these steps a plurality of times and then performing firing.

However, when this multilayer inductor of the related art is manufactured, it is clear that the following problems arise. Firing is performed in a state where the coil conductor layers and the magnetic layers are contacting each other, and therefore, when there is a difference in the coefficient of thermal expansion between the coil conductor layers and the magnetic layers, the magnetic layers contract while being affected by the contraction of the coil conductor layers. Consequently, residual stress is generated in the magnetic layers, the residual stress causes the magnetic characteristics of the magnetic layers to be degraded, and as a result the L value (inductance value) and the Q value (quality factor value) are degraded. Furthermore, since residual stress is generated in the magnetic layers, there are large variations in the L value and Q value between individual manufactured products, and it is not possible to stably manufacture products of uniform quality.

SUMMARY

Accordingly, the present disclosure addresses the problem of providing a multilayer inductor manufacturing method with which degradation of the L value and the Q value can be reduced and with which variations in the L value and Q value between individual manufactured products can be made small.

A multilayer inductor manufacturing method according to a preferred embodiment of the present disclosure includes a first step of stacking a first coil conductor layer on a first magnetic layer; a second step of stacking a first burn-away material on width-direction side surfaces of the first coil conductor layer; a third step of stacking a second magnetic layer on the first burn-away material and the first magnetic layer such that the second magnetic layer does not contact the first coil conductor layer; a fourth step of stacking a second burn-away material on the second magnetic layer so as to be outside an upper surface of the first coil conductor layer in the width direction; a fifth step of stacking a second coil conductor layer on the upper surface of the first coil conductor layer and the second burn-away material such that the second coil conductor layer does not contact the second magnetic layer; a sixth step of stacking a third burn-away material on width-direction side surfaces and an upper surface of the second coil conductor layer; a seventh step of stacking a third magnetic layer on width-direction side surfaces of the third burn-away material and the second magnetic layer such that the third magnetic layer does not contact the second coil conductor layer; an eighth step of stacking a fourth magnetic layer on the third burn-away material and the third magnetic layer; and a ninth step of burning away the first, second, and third burn-away materials by performing firing.

With the multilayer inductor manufacturing method according to the preferred embodiment of the present disclosure, burn-away materials are provided between the magnetic layers and the side surfaces of the first coil conductor layer and the side surfaces, the lower surface, and the upper surface of the second coil conductor layer, and therefore firing is performed in a state where the side surfaces of the first coil conductor layer and the side surfaces, the lower surface and the upper surface of the second coil conductor layer do not contact the magnetic layers. Consequently, the magnetic layers contract in a state where the magnetic layers are unlikely to be affected by contraction of the coil conductor layers even in the case where there is a difference in the coefficient of thermal expansion between the coil conductor layers and the magnetic layers. As a result, residual stress in the magnetic layers can be reduced and degradation of the L value (inductance value) and the Q value (quality factor value) can be reduced. Furthermore, since the residual stress in the magnetic layers can be reduced, variations in the L value and Q value between individual manufactured products can be made small, and products of uniform quality can be stably manufactured.

In addition, in the multilayer inductor manufacturing method, in the first step, a burn-away material may be provided between part of a lower surface of the first coil conductor layer and the first magnetic layer. In this case, since firing is performed in a state where part of the lower surface of the first coil conductor layer is not in contact with the first magnetic layer, residual stress in the first magnetic layer can be reduced even more, degradation of the L value and the Q value can be reduced even more, and variations in the L value and the Q value between individual manufactured products can be made even smaller.

Furthermore, in the multilayer inductor manufacturing method, in the fifth step, a maximum width of the second coil conductor layer may be made to be smaller than a maximum width of the first coil conductor layer. In this case, the surface area of the second coil conductor layer that faces the magnetic layer can be made smaller by making the maximum width of the second coil conductor layer smaller. As a result, when firing is performed, the magnetic layer is even less likely to be affected by the second coil conductor layer. Therefore, residual stress in the magnetic layer can be reduced even more, degradation of the L value and the Q value can be reduced even more, and variations in the L value and the Q value between individual manufactured products can be made even smaller. Furthermore, the second coil conductor layer can be more stably stacked on the first coil conductor layer as a result of making the maximum width of the second coil conductor layer smaller.

In addition, in the multilayer inductor manufacturing method, a single coil wiring line may be formed from three or more coil conductor layers stacked on top of one another by repeating the second to fifth steps a plurality of times after the fifth step, and two or more of the coil wiring lines may be electrically connected in parallel with each other. In this case, single coil wiring lines are each formed from three or more coil conductor layers and two or more of such coil wiring lines are electrically connected in parallel with each other, and therefore coil conductor layers that are directly stacked on top of one another and are in surface contact with each other can be separately arranged and coil wiring lines having low direct-current resistances can be stably formed.

In addition, in the multilayer inductor manufacturing method, a single coil wiring line may be formed from two coil conductor layers stacked on top of one another and two or more of the coil wiring lines may be electrically connected in parallel with each other. In this case, since the number of coil conductor layers that form a single coil wiring line is two, the number of coil conductor layers that are directly stacked on top of one another and are in surface contact with each other can be made small, and coil wiring lines having low direct-current resistances can be stably formed.

In addition, in the multilayer inductor manufacturing method, among the two or more coil wiring lines that are electrically connected in parallel with each other, the number of coil conductor layers forming at least one coil wiring line may be different from the number of coil conductor layers forming another coil wiring line. In this case, the impedance can be easily adjusted.

In addition, the multilayer inductor manufacturing method may further include a step of stacking a fourth burn-away material on an upper surface of the third burn-away material between the seventh step and the eighth step, the fourth magnetic layer may stacked on the fourth burn-away material and the third magnetic layer in the eighth step, and the first, second, third, and fourth burn-away materials may be burnt away by being fired in the ninth step. In this case, there is a risk of cracks being formed in the third burn-away material due to the third burn-away material being pulled toward the outside in the width direction by the third magnetic layer when the third magnetic layer dries out, but the fourth burn-away material fills the cracks in the third burn-away material, and therefore the fourth magnetic layer can be prevented from entering the cracks in the third burn-away material. Consequently the second coil conductor layer can be prevented from contacting the fourth magnetic layer.

In addition, a multilayer inductor according to a preferred embodiment of the present disclosure includes an element body formed by stacking magnetic layers in a stacking direction; and a coil that is provided inside the element body and wound in a substantially helical shape.

The coil is formed by stacking in the stacking direction a plurality of coil wiring lines that are wound in substantially planar shapes, and the coil wiring lines each include a plurality of coil conductor layers that are stacked in the stacking direction so as to be in surface contact with each other, and in a cross section, which is taken along the stacking direction, of at least one coil wiring line among the plurality of coil wiring lines, there are hollow portions between the magnetic layers and width-direction side surfaces of the plurality of coil conductor layers, an upper surface of an uppermost coil conductor layer, a lower surface of at least one coil conductor layer among second and subsequent coil conductor layers.

In this case, in a cross section, which is taken along the stacking direction, of at least one coil wiring line, there are hollow portions between the magnetic layers and the width-direction side surfaces of a plurality of coil conductor layers, the upper surface of the uppermost coil conductor layer, and the lower surface of at least one coil conductor layer among the second and subsequent coil conductor layers. Consequently, even when there is a difference in the coefficient of thermal expansion between the coil conductor layers and the magnetic layers, the degree of contact between the magnetic layers and the coil conductor layers is reduced, and therefore residual stress in the magnetic layers can be reduced and degradation of the L value and the Q value can be reduced. Furthermore, since the residual stress in the magnetic layers can be reduced, variations in the L value and Q value between individual manufactured products can be made small, and products of uniform quality can be stably manufactured.

In addition, in the multilayer inductor, in the at least one coil wiring line, a maximum width of the second and subsequent coil conductor layers may be smaller than a maximum width of a lowermost coil conductor layer. In this case, stacking of the plurality of coil conductor layers is made more stable.

Furthermore, in the multilayer inductor, two or more of the coil wiring lines may be electrically connected in parallel with each other. In this case, the number of coil conductor layers that are directly stacked on top of one another and are in surface contact with each other can be made small, and coil wiring lines having low direct-current resistances can be stably formed.

In addition, in the multilayer inductor, among the two or more coil wiring lines that are electrically connected in parallel with each other, the number of coil conductor layers forming at least one coil wiring line may be different from the number of coil conductor layers forming another coil wiring line. In this case, the impedance can be easily adjusted.

Other features, elements, characteristics and advantages of the present disclosure will become more apparent from the following detailed description of preferred embodiments of the present disclosure with reference to the attached drawings.

DETAILED DESCRIPTION

Hereafter, the present disclosure will be described in detail in the form of illustrative embodiments.

First Embodiment

Figure 1:
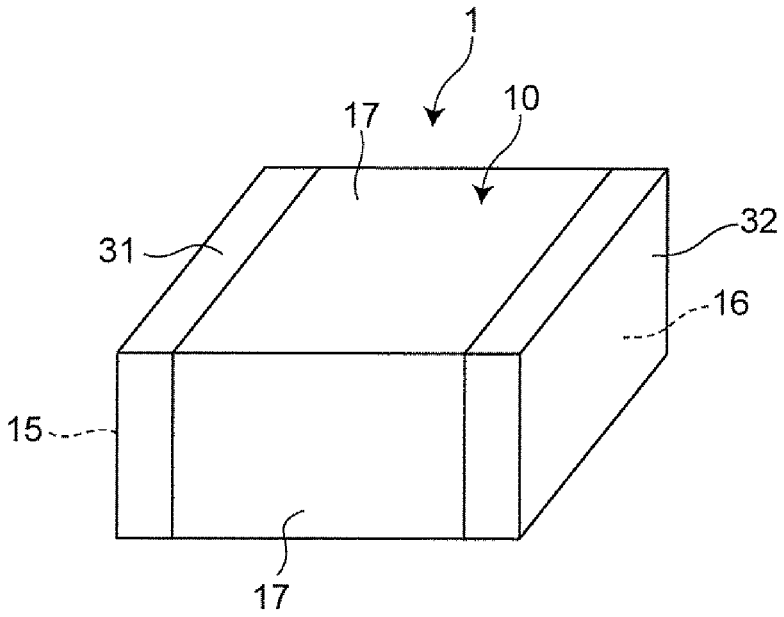
FIG. 1 is a perspective view illustrating a multilayer inductor according to a first embodiment of the present disclosure.
Figure 2:
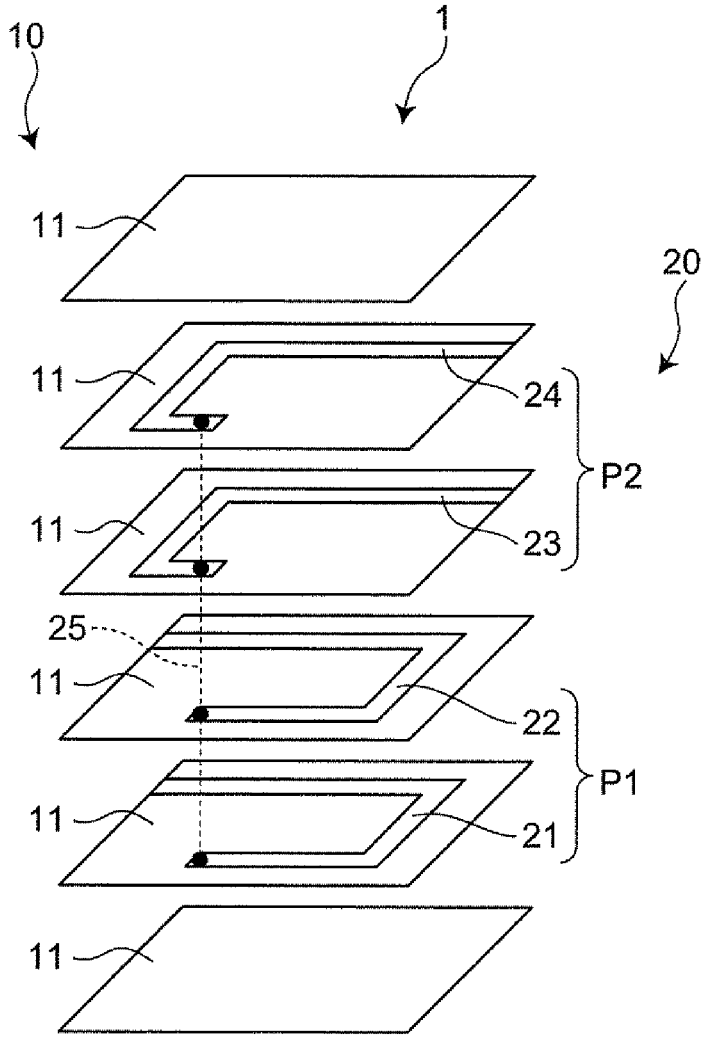
FIG. 2 is an exploded perspective view of the multilayer inductor.

FIG. 1 is a perspective view illustrating a multilayer inductor according to a first embodiment of the present disclosure. FIG. 2 is an exploded perspective view of the multilayer inductor according to the first embodiment of the present disclosure. As illustrated in FIGS. 1 and 2, a multilayer inductor 1 includes an element body 10, a coil 20 that is provided inside the element body 10, and a first outer electrode 31 and a second outer electrode 32 that are provided on surfaces of the element body 10 and are electrically connected to the coil 20.

The multilayer inductor 1 is electrically connected to wiring of a circuit board, which is not illustrated, via first and second outer electrodes 31 and 32. The multilayer inductor 1 is, for example, used as a noise-removing filter and is used in an electronic appliance such as a personal computer, a DVD player, a digital camera, a TV, a cellular phone, car electronics, or the like.

The element body 10 includes a plurality of magnetic layers 11, and the magnetic layers 11 are stacked on top of one another in a stacking direction. The magnetic layers 11 are composed of a magnetic material such as a Ni—Cu—Zn based material, for example. In addition, non-magnetic layers may be included in parts of the element body 10.

The element body 10 is formed so as to have a substantially rectangular parallelepiped shape. Surfaces of the element body 10 include a first end surface 15, a second end surface 16 that is located on the opposite side from the first end surface 15, and four side surfaces 17 that are located between the first end surface 15 and the second end surface 16. The first end surface 15 and the second end surface 16 face each other in a direction that is perpendicular to the stacking direction.

The first outer electrode 31 covers the entire first end surface 15 of the element body 10 and covers end portions of the side surfaces 17 of the element body 10 that are located on the first end surface 15 side. The second outer electrode 32 covers the entire second end surface 16 of the element body 10 and covers end portions of the side surfaces 17 of the element body 10 that are located on the second end surface 16 side.

The coil 20 is wound in a substantially helical shape in the stacking direction. A first end of the coil 20 is exposed from the first end surface 15 of the element body 10 and is electrically connected to the first outer electrode 31. A second end of the coil 20 is exposed from the second end surface 16 of the element body 10 and is electrically connected to the second outer electrode 32. The coil 20 is composed of a conductive material such as Ag or Cu, for example.

The coil 20 includes a plurality of coil wiring lines 21, 22, 23, and 24, which are each wound in a substantially planar shape. The plurality of coil wiring lines 21, 22, 23, and 24 are provided on the magnetic layers 11 and are stacked in the stacking direction.

The first coil wiring line 21 of the first layer and the second coil wiring line 22 of the second layer are electrically connected in parallel with each other and form a first parallel group P1. The third coil wiring line 23 of the third layer and the fourth coil wiring line 24 of the fourth layer are electrically connected in parallel with each other and form a second parallel group P2. The first parallel group P1 and the second parallel group P2 are electrically connected in series between the first outer electrode 31 and the second outer electrode 32.

More specifically, the first coil wiring line 21 and the second coil wiring line 22 have substantially the same shape. A first end of the first coil wiring line 21 and a first end of the second coil wiring line 22 are connected to the first outer electrode 31. A second end of the first coil wiring line 21 and a second end of the second coil wiring line 22 are connected to each other via a connection portion 25. Thus, the first coil wiring line 21 and the second coil wiring line 22 are at the same potential. The connection portion 25 is provided so as to penetrate through the magnetic layer 11 in the stacking direction.

The third coil wiring line 23 and the fourth coil wiring line 24 have substantially the same shape. A first end of the third coil wiring line 23 and a first end of the fourth coil wiring line 24 are connected to each other via a connection portion 25. A second end of the third coil wiring line 23 and a second end of the fourth coil wiring line 24 are connected to the second outer electrode 32. Thus, the third coil wiring line 23 and the fourth coil wiring line 24 are at the same potential.

The second ends of the first and second coil wiring lines 21 and 22 and the first ends of the third and fourth coil wiring lines 23 and 24 are connected to each other via connection portions 25. Thus, the first and second coil wiring lines 21 and 22 (first parallel group P1) and the third and fourth coil wiring lines 23 and 24 (second parallel group P2) are connected in series with each other.

Figure 3:
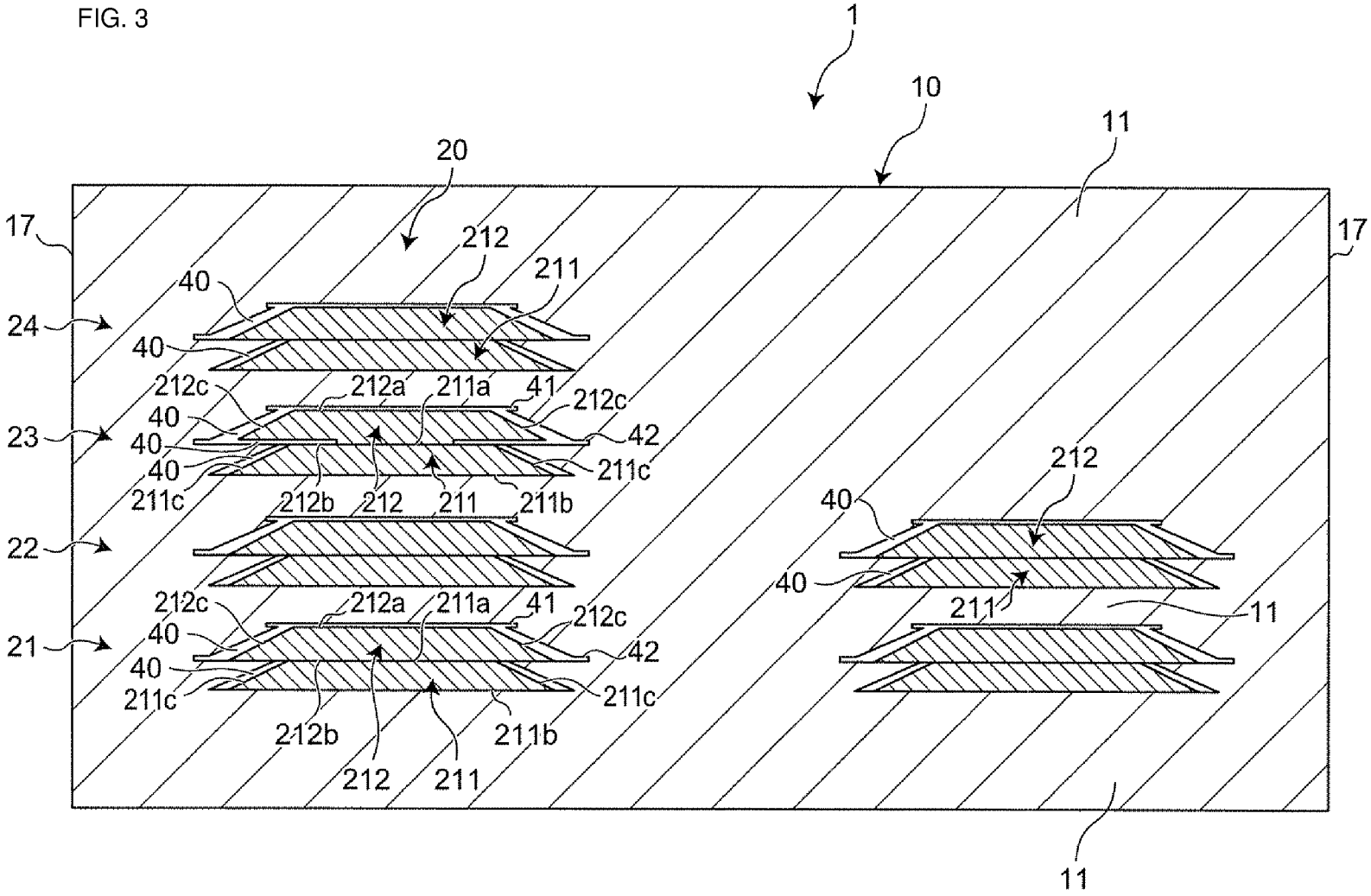
FIG. 3 is a sectional view of the multilayer inductor.

FIG. 3 is a sectional view of the multilayer inductor 1. As illustrated in FIG. 3, the first to fourth coil wiring lines 21 to 24 each include a lower-layer first coil conductor layer 211 and an upper-layer second coil conductor layer 212. The first coil conductor layer 211 and the second coil conductor layer 212 are stacked one on top of the other in the stacking direction so as to be in surface contact with each other.

The first coil conductor layer 211 and the second coil conductor layer 212 are each formed so as to have a substantially trapezoidal shape in a cross section taken along the stacking direction. The first coil conductor layer 211 has an upper surface 211*a*, a lower surface 211*b*, and side surfaces 211*c* on both sides in the width direction. The width of the upper surface 211*a* is smaller than the width of the lower surface 211*b*. The second coil conductor layer 212 has an upper surface 212*a*, a lower surface 212*b*, and side surfaces 212*c* on both sides in the width direction, similarly to the first coil conductor layer 211. The upper surface 211*a* of the first coil conductor layer 211 and the lower surface 212*b* of the second coil conductor layer 212 are in surface contact with each other.

The first coil wiring line 21 has hollow portions 40 between the element body 10 (magnetic layers 11) and the width-direction side surfaces 211*c* and 212*c* of the first and second coil conductor layers 211 and 212 and the upper surface 212*a* of the second coil conductor layer 212.

The hollow portions 40 include first extending portions 41 and second extending portions 42. The first extending portions 41 extend toward the outside in the width direction on the upper surface 212*a* side of the second coil conductor layer 212. The second extending portions 42 extend toward the outside in the width direction on the lower surface 212*b* side of the second coil conductor layer 212.

Similarly to the first coil wiring line 21, the second, third, and fourth coil wiring lines 22, 23, and 24 each have hollow portions 40 between the magnetic layers 11 and the width-direction side surfaces 211*c* and 212*c* of the first and second coil conductor layers 211 and 212 and the upper surface 212*a* of the second coil conductor layer 212. The third coil wiring line 23 additionally has a hollow portion 40 between the lower surface 212*b* of the second coil conductor layer 212 and the magnetic layer 11. The hollow portion 40 at the lower surface 212*b* of the second coil conductor layer 212 extends between part of the upper surface 211*a* of the first coil conductor layer 211 and the lower surface 212*b* of the second coil conductor layer 212.

Next, a method of manufacturing the multilayer inductor 1 will be described.

Figure 4A:
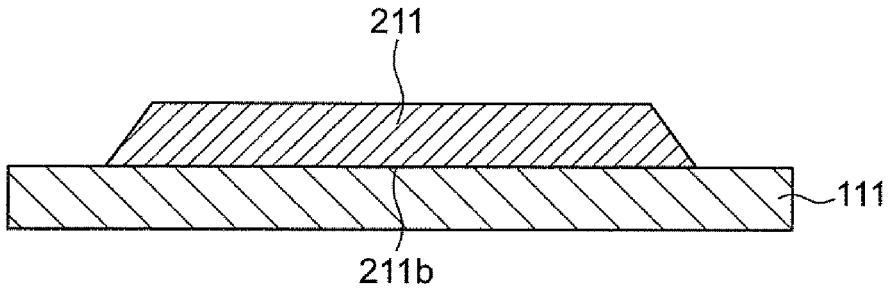
FIG. 4A is an explanatory diagram for explaining a method of manufacturing the multilayer inductor according to the first embodiment.

As illustrated in FIG. 4A, the first coil conductor layer 211 is stacked on a first magnetic layer 111 (first step). The first magnetic layer 111 is formed by applying and then drying a magnetic paste, for example. The first coil conductor layer 211 is formed by applying and then drying a conductive paste, for example.

Figure 4B:
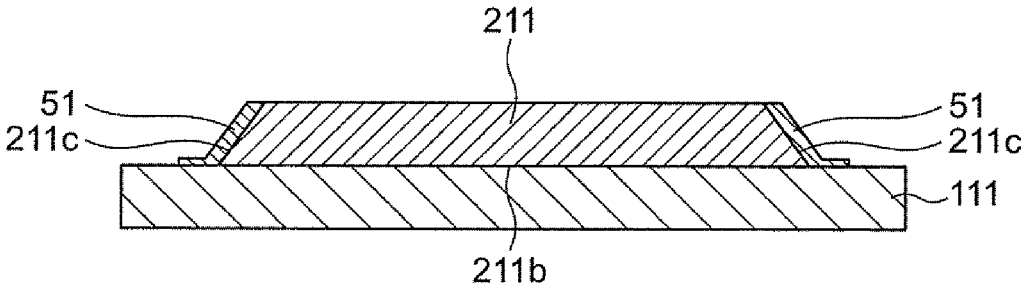
FIG. 4B is an explanatory diagram for explaining the method of manufacturing the multilayer inductor according to the first embodiment.

As illustrated in FIG. 4B, a first burn-away material 51 is stacked on the width-direction side surfaces 211*c* of the first coil conductor layer 211 (second step). The first burn-away material 51 is composed of a material that burns away when subjected to firing, and is composed of a resin material for example. The first burn-away material 51 is preferably applied so as to protrude somewhat in the width direction toward the outside from the two ends of the first coil conductor layer 211 so that the first coil conductor layer 211 can be covered by the first burn-away material 51 with certainty even in the case where positional deviations or the like occur when applying the first burn-away material 51.

Figure 4C:
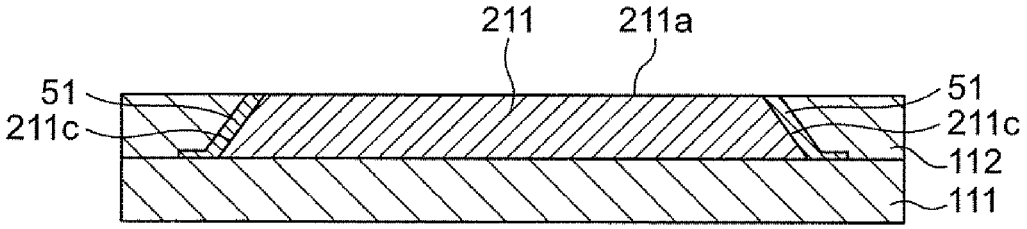
FIG. 4C is an explanatory diagram for explaining the method of manufacturing the multilayer inductor according to the first embodiment.

As illustrated in FIG. 4C, a second magnetic layer 112 is stacked on the first burn-away material 51 and the first magnetic layer 111 so as to not contact the first coil conductor layer 211 (third step). The upper surface 211*a* of the first coil conductor layer 211 and the upper surface of the first burn-away material 51 are exposed from the second magnetic layer 112. Due to the first burn-away material 51, the side surfaces 211*c* of the first coil conductor layer 211 do not contact the second magnetic layer 112.

Figure 4D:
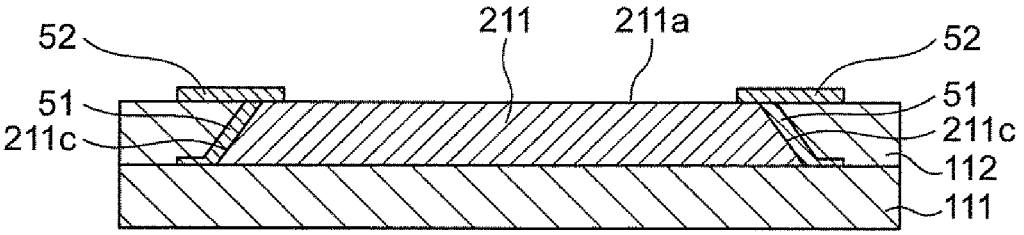
FIG. 4D is an explanatory diagram for explaining the method of manufacturing the multilayer inductor according to the first embodiment.

As illustrated in FIG. 4D, a second burn-away material 52 is stacked on the second magnetic layer 112, which is outside the upper surface 211*a* of the first coil conductor layer 211 in the width direction (fourth step). The second burn-away material 52 overlaps the upper surface of the first burn-away material 51 and the upper surface of the second magnetic layer 112.

Figure 4E:
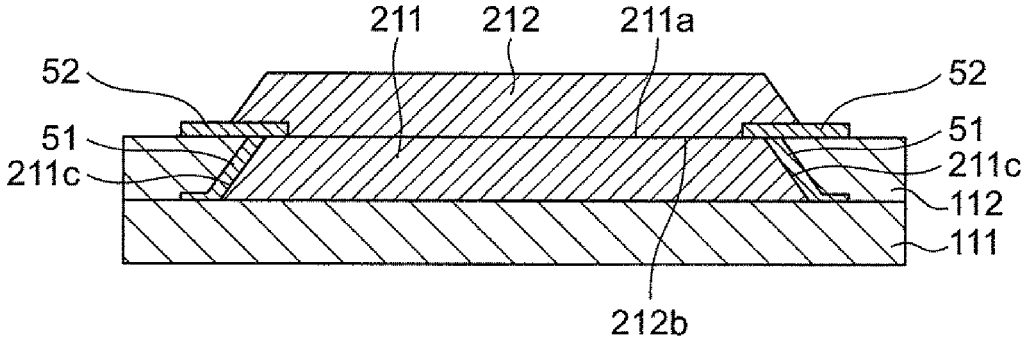
FIG. 4E is an explanatory diagram for explaining the method of manufacturing the multilayer inductor according to the first embodiment.

As illustrated in FIG. 4E, the second coil conductor layer 212 is stacked on the upper surface 211*a* of the first coil conductor layer 211 and on the second burn-away material 52 so as to not contact the second magnetic layer 112 (fifth step). The lower surface 212*b* of the second coil conductor layer 212 is in surface contact with the upper surface 211*a* of the first coil conductor layer 211. The end portions of the lower surface 212*b* of the second coil conductor layer 212 in the width direction contact the second burn-away material 52. Due to the second burn-away material 52, the lower surface 212*b* of the second coil conductor layer 212 does not contact the second magnetic layer 112.

Figure 4F:
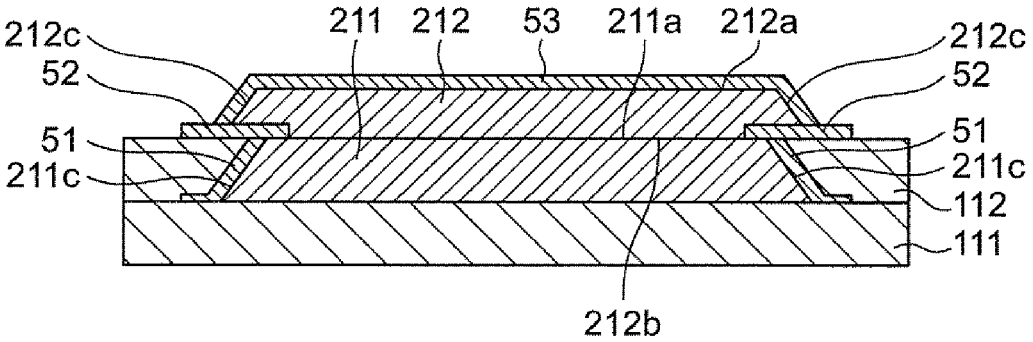
FIG. 4F is an explanatory diagram for explaining the method of manufacturing the multilayer inductor according to the first embodiment.

As illustrated in FIG. 4F, a third burn-away material 53 is stacked on the width-direction side surfaces 212*c* and the upper surface 212*a* of the second coil conductor layer 212 (sixth step). In other words, the exposed surfaces of the second coil conductor layer 212 are covered by the third burn-away material 53.

Figure 4G:
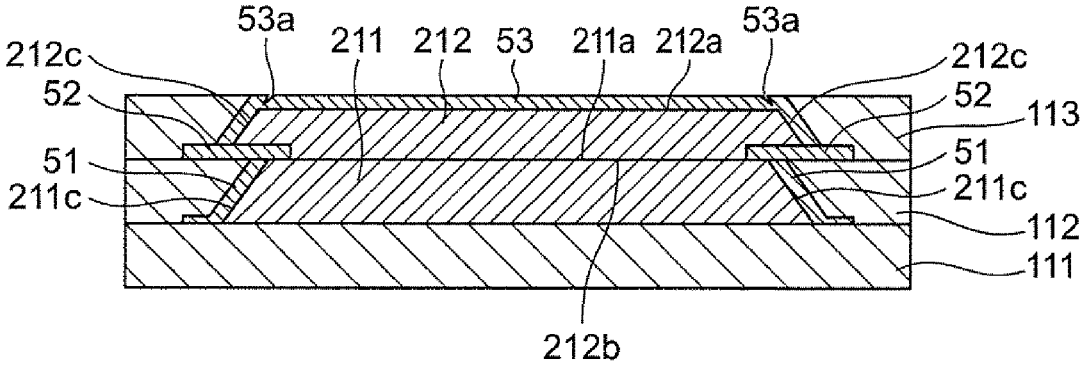
FIG. 4G is an explanatory diagram for explaining the method of manufacturing the multilayer inductor according to the first embodiment.

As illustrated in FIG. 4G, a third magnetic layer 113 is stacked on the width-direction side surfaces of the third burn-away material 53 and the second magnetic layer 112 so as not to contact the second coil conductor layer 212 (seventh step). The upper surface of the third burn-away material 53 is exposed from the third magnetic layer 113. Due to the third burn-away material 53, the side surfaces 212*c* of the second coil conductor layer 212 do not contact the third magnetic layer 113.

In this case, when the third magnetic layer 113 dries out, since the third burn-away material 53 is stacked on the entirety of the upper surface 212*a* of the second coil conductor layer 212, there is a risk of cracks 53*a* being formed in the third burn-away material 53 due to the third burn-away material 53 being pulled by the third magnetic layer 113 toward the outside in the width direction. Hereafter, the description will assume that the cracks 53*a* are generated.

Figure 4H:
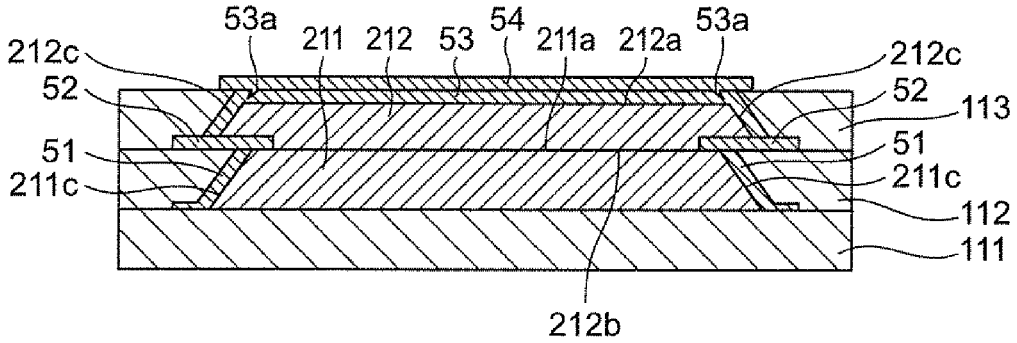
FIG. 4H is an explanatory diagram for explaining the method of manufacturing the multilayer inductor according to the first embodiment.

As illustrated in FIG. 4H, a fourth burn-away material 54 is stacked on the upper surface of the third burn-away material 53 (eighth step). The fourth burn-away material 54 is wider than the upper surface of the third burn-away material 53. The fourth burn-away material 54 fills the cracks 53*a* in the third burn-away material 53.

Figure 4I:
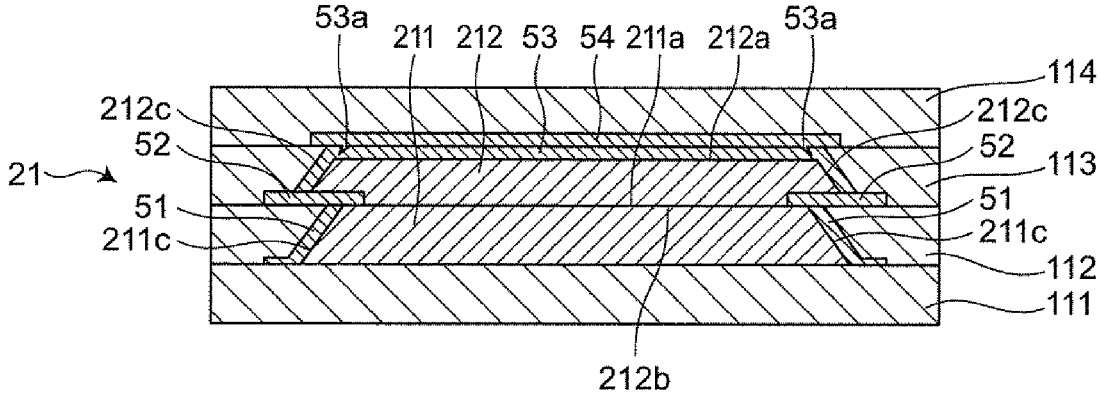
FIG. 4I is an explanatory diagram for explaining the method of manufacturing the multilayer inductor according to the first embodiment.

As illustrated in FIG. 4I, a fourth magnetic layer 114 is stacked on the fourth burn-away material 54 and the third magnetic layer 113 (ninth step). Since the fourth burn-away material 54 filled the cracks 53*a* in the third burn-away material 53, the fourth magnetic layer 114 can be prevented from entering the cracks 53*a* in the third burn-away material 53. The upper surface 212*a* of the second coil conductor layer 212 does not contact the fourth magnetic layer 114 due to the third and fourth burn-away materials 53 and 54. The first coil wiring line 21 is thus manufactured.

Figure 4J:
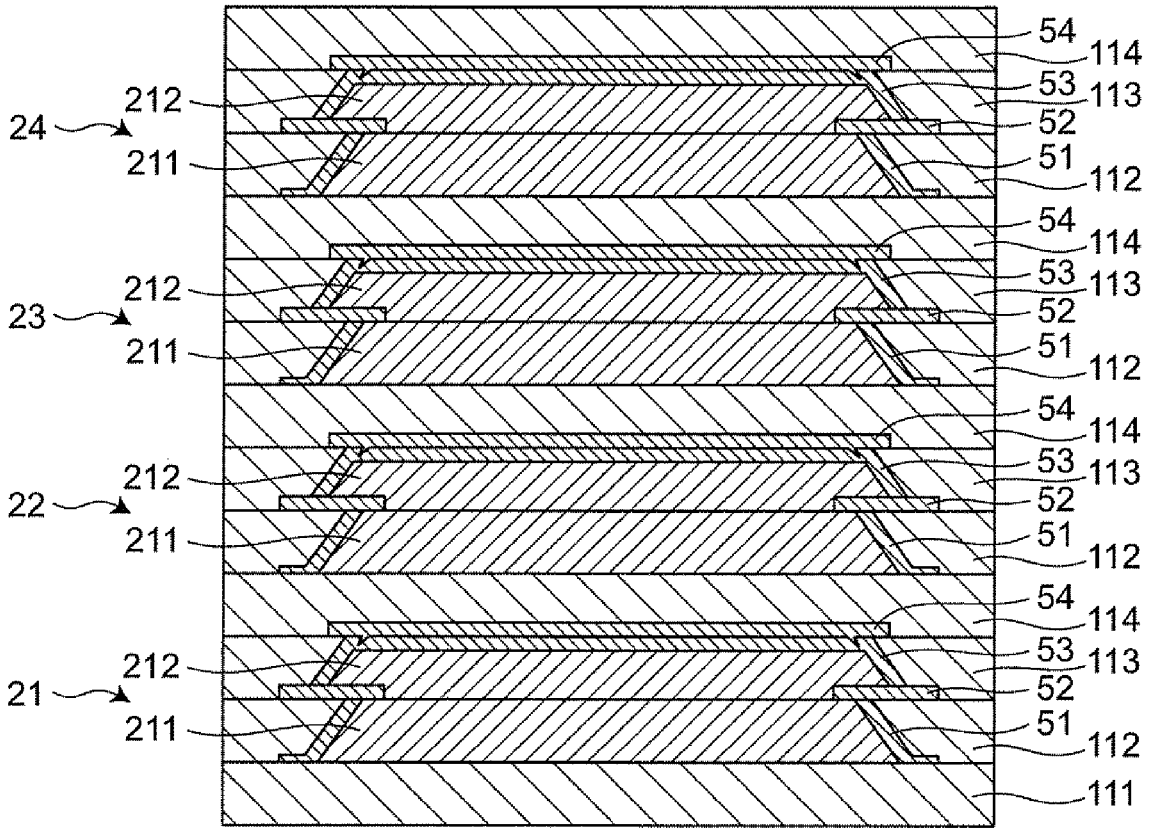
FIG. 4J is an explanatory diagram for explaining the method of manufacturing the multilayer inductor according to the first embodiment.

After that, as illustrated in FIG. 4J, the second coil wiring line 22, the third coil wiring line 23, and the fourth coil wiring line 24 are manufactured by repeating the second to ninth steps three times. Next, the first, second, third, and fourth burn-away materials 51 to 54 are burnt away by performing firing (tenth step). Thus, as illustrated in FIG. 3, the hollow portions 40 are formed between the first to fourth coil wiring lines 21 to 24 and the magnetic layers 11. After that, as illustrated in FIG. 1, the multilayer inductor 1 is manufactured by forming the first and second outer electrodes 31 and 32 on the element body 10.

According to the method of manufacturing the multilayer inductor 1, the burn-away materials 51 to 54 are disposed between the magnetic layers 111 to 114 and the side surfaces 211*c* of the first coil conductor layer 211 and the side surfaces 212*c*, the lower surface 212*b*, and the upper surface 212*a* of the second coil conductor layer 212, and therefore firing is performed in a state where the side surfaces 211*c* of the first coil conductor layer 211 and the side surfaces 212*c*, the lower surface 212*b*, and the upper surface 212*a* of the second coil conductor layer 212 do not contact the magnetic layers 111 to 114. Consequently, the magnetic layers 111 to 114 contract in a state where the magnetic layers 111 to 114 are unlikely to be affected by contraction of the coil conductor layers 211 and 212 even in the case where there is a difference in the coefficient of thermal expansion between the coil conductor layers 211 and 212 and the magnetic layers 111 to 114. As a result, residual stress in the magnetic layers 111 to 114 can be reduced and degradation of the L value (inductance value) and the Q value (quality factor value) can be reduced. Furthermore, since the residual stress in the magnetic layers 111 to 114 can be reduced, variations in the L value and Q value between individual manufactured products can be made small, and products of uniform quality can be stably manufactured. In addition, since the coil wiring lines 21 to 24 are each formed of the first coil conductor layer 211 and the second coil conductor layer 212, which are in surface contact with each other, the direct-current resistance of the inductor can be reduced.

After the burn-away materials 51 to 54 have been fired, as illustrated in FIG. 3, the hollow portions 40 are generated between the lower surface 212*b* of the second coil conductor layer 212 and the magnetic layer 11 in the third coil wiring line 23. In contrast, hollow portions 40 are not generated between the lower surfaces 212*b* of the second coil conductor layers 212 and the magnetic layers 11 in the first, second, and fourth coil wiring lines 21, 22, and 24, but the lower surfaces 212*b* of the second coil conductor layers 212 and the magnetic layers 11 do not contact each other when the burn-away materials 51 to 54 are fired due to the presence of the second burn-away material 52, and therefore residual stress in the magnetic layers 11 can be reduced. After the burn-away materials 51 to 54 have been fired, the hollow portions 40 are generated between the lower surface 212*b* of the second coil conductor layer 212 and the magnetic layer 11 in at least one coil wiring line.

According to the multilayer inductor 1, since the multilayer inductor 1 has the hollow portions 40 between the first coil conductor layers 211 and the second coil conductor layers 212 and the magnetic layers 111 to 114, contact between the magnetic layers 111 to 114 and the coil conductor layers 211 and 212 can be reduced even when there is a difference in the coefficient of thermal expansion between the coil conductor layers 211 and 212 and the magnetic layers 111 to 114. As a result, the residual stress in the magnetic layers 111 to 114 can be reduced and degradation of the L value and the Q value can be reduced. Furthermore, since the residual stress in the magnetic layers 111 to 114 can be reduced, variations in the L value and Q value between individual manufactured products can be made small, and products of uniform quality can be stably manufactured.

Furthermore, in addition to each of the coil wiring lines 21 to 24 being formed of the two coil conductor layers 211 and 212 stacked on top of one another, the first coil wiring line 21 and the second coil wiring line 22 are electrically connected in parallel with each other and form the first parallel group P1, and the third coil wiring line 23 and the fourth coil wiring line 24 are electrically connected in parallel with each other and form the second parallel group P2. With this configuration, the number of coil conductor layers 211 and 212 that are directly stacked on top of one another and are in surface contact with each other can be made small, and the coil wiring lines 21 to 24 having low direct-current resistances can be stably formed. In this case, the first parallel group P1 and the second parallel group P2 may be each formed by electrically connecting three or more coil wiring lines in parallel with each other. Thus, coil wiring lines 21 to 24 having an even lower direct-current resistance can be stably formed.

Furthermore, each of the coil wiring lines 21 to 24 is formed of the two coil conductor layers 211 and 212, and as a result the difference in shrinkage behavior between the coil conductor layers and the magnetic layers can be reduced and the hollow portions 40 can be stably formed. The rate of shrinkage of the paste of the coil conductor layers is preferably higher than the rate of shrinkage of the paste of the magnetic layers in order that the hollow portions can be easily formed. The temperature at which the paste of the coil conductor layers starts to shrink is preferably lower than the temperature at which the paste of the magnetic layers starts to shrink so that the hollow portions can be easily formed.

The coil may be formed of a plurality of coil wiring lines of other than four. In addition, the coil wiring lines may be each formed of three or more coil conductor layers. In this case, in a cross section, which is taken along the stacking direction, of at least one coil wiring line among a plurality of coil wiring lines, there are hollow portions between the magnetic layers and the width-direction side surfaces of the plurality of coil conductor layers, the upper surface of the uppermost coil conductor layer and the lower surface of at least one coil conductor layer among the second and subsequent coil conductor layers.

Furthermore, in the method of manufacturing the multilayer inductor, the eighth step of providing the fourth burn-away material may be omitted in the case where cracks are not generated in the third burn-away material. The third magnetic layer and the fourth magnetic layer may be simultaneously formed.

Furthermore, in the case where stacked magnetic layers are manufactured using green sheets, a step of pressure bonding may be performed in order make the layers closely contact each other. In addition, in the case where stacked coil wiring lines are not superposed with each other except for at a connection portion, an insulating magnetic layer need not be formed between the vertically adjacent coil wiring lines. In addition, the first to fourth coil wiring lines may be electrically connected in series with each other. In other words, a coil may be formed in which the coil wiring lines are not electrically connected in parallel with each other.

In addition, the second to fifth steps may be repeated a plurality of times after the fifth step to form a single coil wiring line from three or more coil conductor layers stacked on top of one another and two or more of such coil wiring lines may be electrically connected in parallel with each other. With this configuration, coil conductor layers that are directly stacked on top of one another and are in surface contact with each other can be separately arranged, and the coil wiring lines having low direct-current resistances can be stably formed.

Second Embodiment

Figure 5:
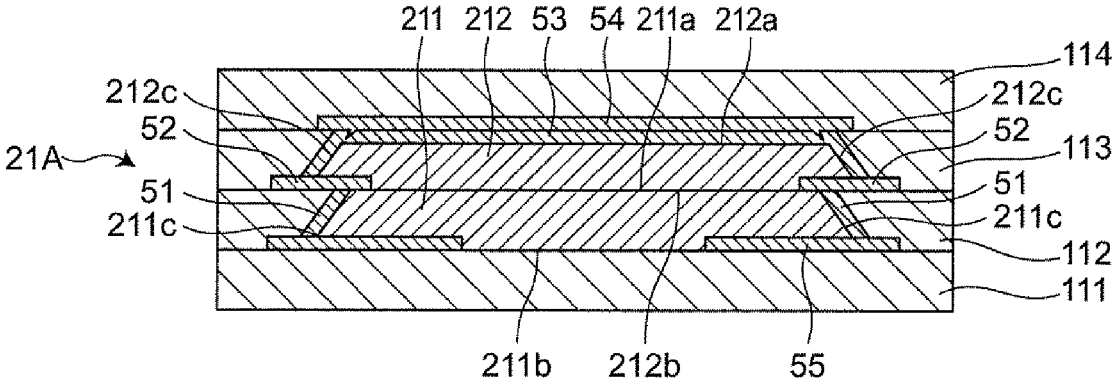
FIG. 5 is a sectional view illustrating a method of manufacturing a multilayer inductor according to a second embodiment of the present disclosure.

FIG. 5 is a sectional view illustrating a method of manufacturing a multilayer inductor according to a second embodiment of the present disclosure. The first step of the second embodiment is different from that of the first embodiment. This difference will be described below. In the second embodiment, the same symbols as in the first embodiment are used to denote constituent parts that are the same as in the first embodiment and therefore description of those constituent parts is omitted.

As illustrated in FIG. 5, in contrast to the first step of the first embodiment (FIG. 4A), a burn-away material 55 is provided between part of the lower surface 211*b* of the first coil conductor layer 211 and the first magnetic layer 111 in the first step of the second embodiment. The burn-away material 55 is provided in regions extending from the two ends of the lower surface 211*b* of the first coil conductor layer 211 in the width direction toward the inside by around ⅓ of the width of the lower surface 211*b*, for example. In other respects, a first coil wiring line 21A is manufactured using the same steps as in the first embodiment. After that, the second coil wiring line, the third coil wiring line, and the fourth coil wiring line are manufactured by repeating the same steps and all of the burn-away materials are burnt away by being fired.

According to the second embodiment, since firing is performed in a state where part of the lower surface 211*b* of the first coil conductor layer 211 is not in contact with the first magnetic layer 111, residual stress in the first magnetic layer 111 can be reduced even more, degradation of the L value and the Q value can be reduced even more, and variations in the L value and the Q value between individual manufactured products can be made even smaller. In the thus-manufactured multilayer inductor, there is a hollow portion between the first magnetic layer 111 and part of the lower surface 211*b* of the first coil conductor layer 211 of the first layer.

Third Embodiment

Figure 6:
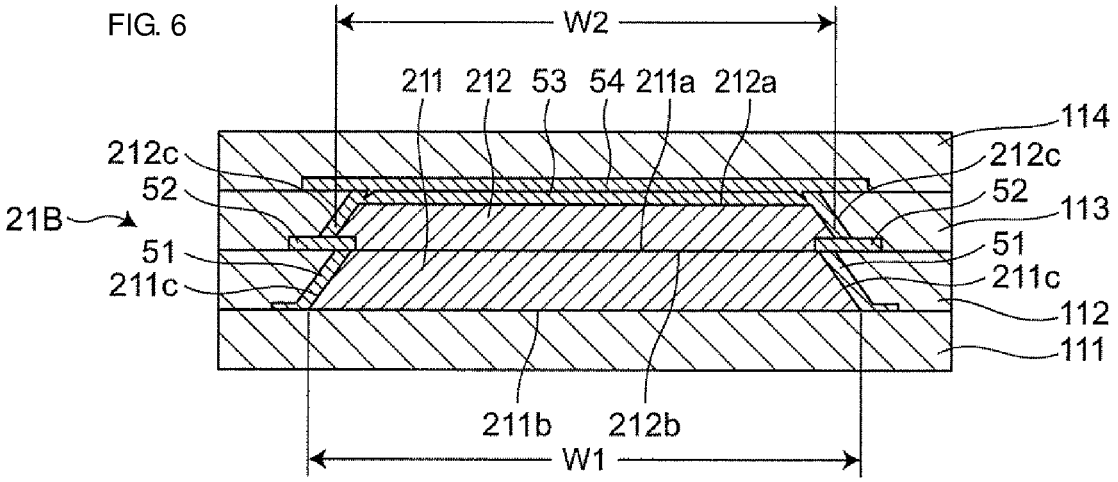
FIG. 6 is a sectional view illustrating a method of manufacturing a multilayer inductor according to a third embodiment of the present disclosure.

FIG. 6 is a sectional view illustrating a method of manufacturing a multilayer inductor according to a third embodiment of the present disclosure. The fifth step of the third embodiment is different from that of the first embodiment. This difference will be described below. In the third embodiment, the same symbols as in the first embodiment are used to denote constituent parts that are the same as in the first embodiment and therefore description of those constituent parts is omitted.

As illustrated in FIG. 6, in contrast to the fifth step of the first embodiment (FIG. 4E), in the fifth step of the third embodiment, a maximum width W2 of the second coil conductor layer 212 (width on lower surface 212*b* side) is made smaller than a maximum width W1 of the first coil conductor layer 211 (width on lower surface 211*b* side). In other respects, a first coil wiring line 21B is manufactured using the same steps as in the first embodiment. After that, the second coil wiring line, the third coil wiring line, and the fourth coil wiring line are manufactured by repeating the same steps and all of the burn-away materials are burnt away by being fired.

According to the third embodiment, the surface area of the second coil conductor layer 212 that faces the magnetic layer can be made smaller by making the maximum width W2 of the second coil conductor layer 212 smaller. Thus, when firing is performed, the magnetic layer is even less likely to be affected by the second coil conductor layer 212. Therefore, residual stress in the magnetic layer can be reduced even more, degradation of the L value and the Q value can be reduced even more, and variations in the L value and the Q value between individual manufactured products can be made even smaller. Furthermore, the second coil conductor layer 212 can be more stably stacked on the first coil conductor layer 211 as a result of making the maximum width W2 of the second coil conductor layer 212 smaller. Thus, the maximum width W2 of the second coil conductor layer 212 is smaller than the maximum width W1 of the first coil conductor layer 211 in the thus-manufactured multilayer inductor.

The coil wiring lines may be each formed of three or more coil conductor layers, and in this case, it is preferable to make the maximum width of each coil conductor layer of the second and subsequent layers smaller than the maximum width of the coil conductor layer of the lowermost layer (first layer). In at least one coil wiring line, the maximum width of the coil conductor layers of the second and subsequent layers may be smaller than the maximum width of the coil conductor layer of the lowermost layer.

Fourth Embodiment

Figure 7:
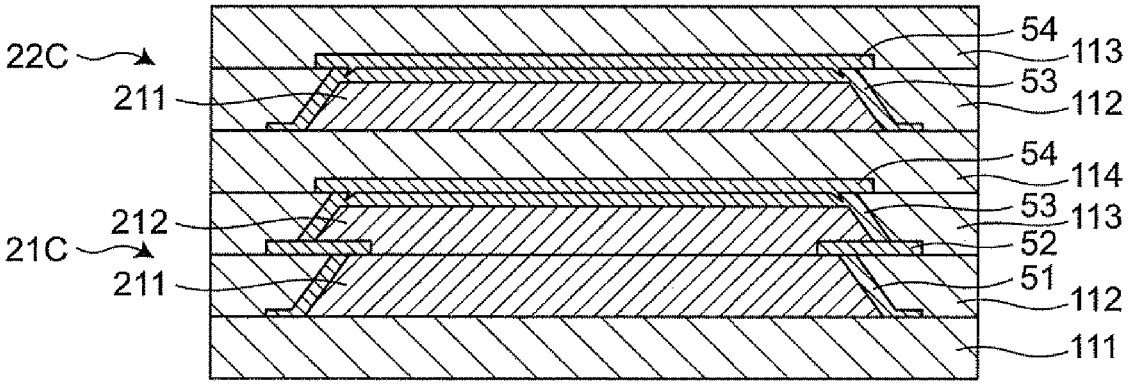
FIG. 7 is a sectional view illustrating a method of manufacturing a multilayer inductor according to a fourth embodiment of the present disclosure.

FIG. 7 is a sectional view illustrating a method of manufacturing a multilayer inductor according to a fourth embodiment of the present disclosure. In the fourth embodiment, the number of layers of the coil wiring lines is different from in the first embodiment. This difference will be described below. In the fourth embodiment, the same symbols as in the first embodiment are used to denote constituent parts that are the same as in the first embodiment and therefore description of those constituent parts is omitted.

As illustrated in FIG. 7, in the fourth embodiment, in a first coil wiring line 21C and a second coil wiring line 22C, which are electrically connected in parallel with each other, the number of layers of the coil conductor layers 211 and 212 that form the first coil wiring line 21C (two layers) is different from the number of layers of the coil conductor layer 211 that forms the second coil wiring line 22C (one layer). With this configuration, the impedance can be easily adjusted.

Three or more coil wiring lines may be electrically connected in parallel with each other, and in this case, the number of coil conductor layers forming at least one coil wiring line is made different from the number of coil conductor layers forming another coil wiring line.

The present disclosure is not limited to the above-described embodiments and design changes can be made within a range that does not depart from the gist of the present disclosure. For example, the characteristic features of the first to fourth embodiments may be combined with each other in various ways.

Example

Figure 8A:
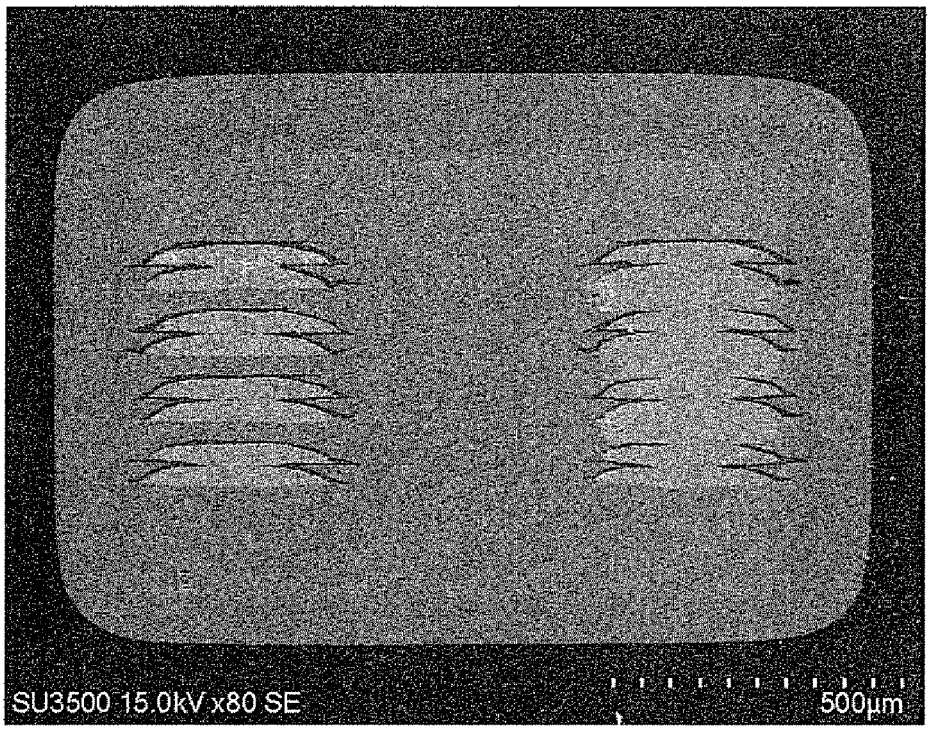
FIG. 8A is an image of a two-layer doubly-wound multilayer inductor prior to firing.
Figure 8B:
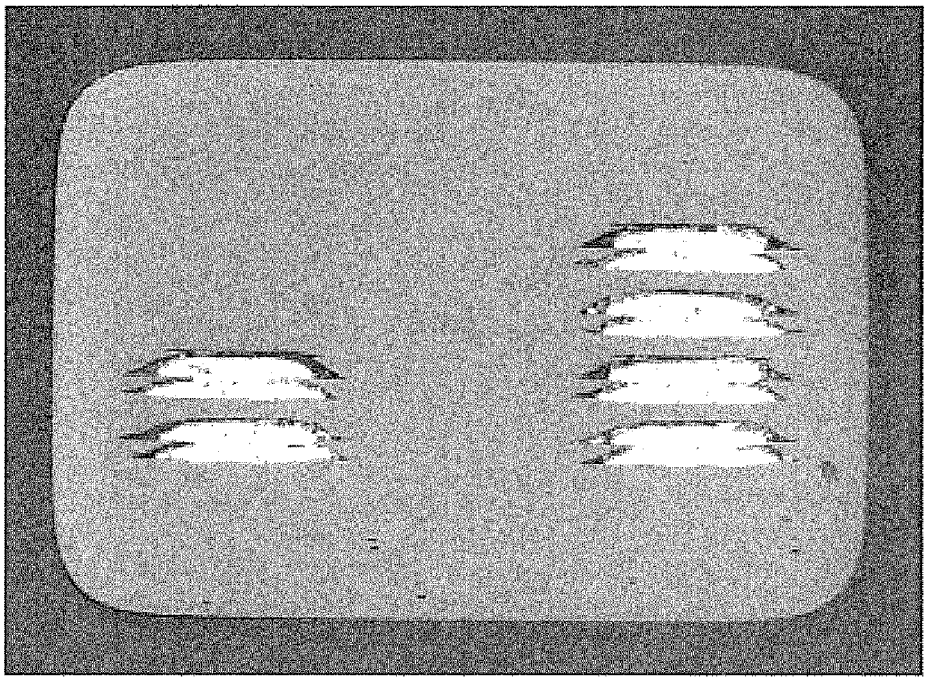
FIG. 8B is an image of a two-layer doubly-wound multilayer inductor after firing.

FIG. 8A is an image of a multilayer inductor prior to firing and FIG. 8B is an image of the multilayer inductor after firing. These images were captured using a scanning electron microscope. The multilayer inductor illustrated in FIGS. 8A and 8B has a structure in which four coil wiring lines are provided, each of which is constituted by two coil conductor layers, and the coil wiring lines, which each have two layers, are connected in parallel with each other, that is, the multilayer inductor has a two-layer doubly-wound structure. In other words, FIG. 8A is an image that corresponds to FIG. 4J and FIG. 8B is an image that corresponds to FIG. 3. As illustrated in FIGS. 8A and 8B, the burn-away material is fired and the hollow portions are formed.

Figure 9A:
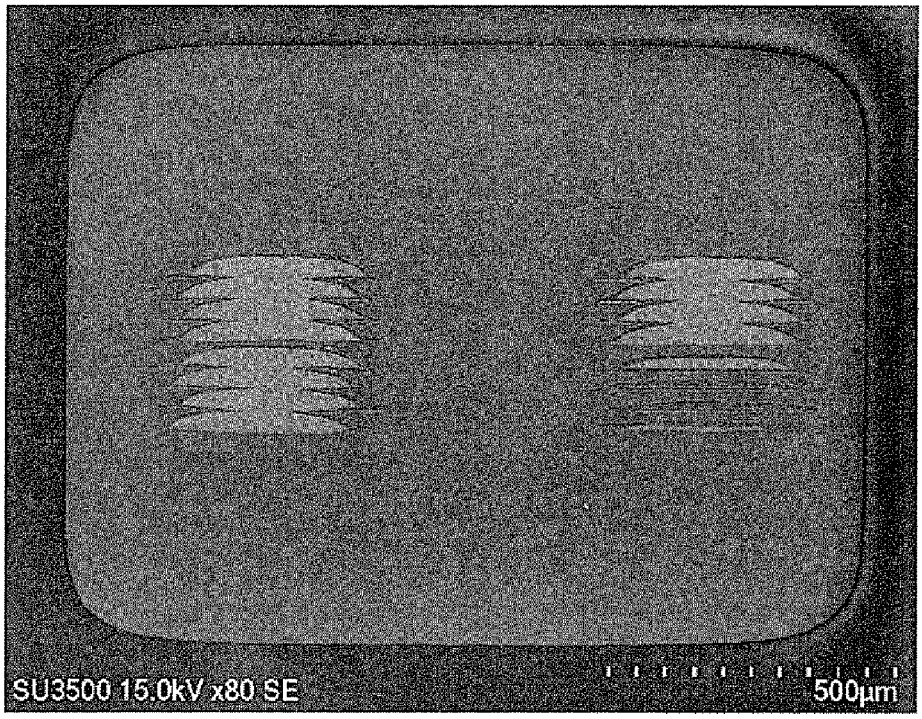
FIG. 9A is an image of a four-layer singly-wound multilayer inductor prior to firing.
Figure 9B:
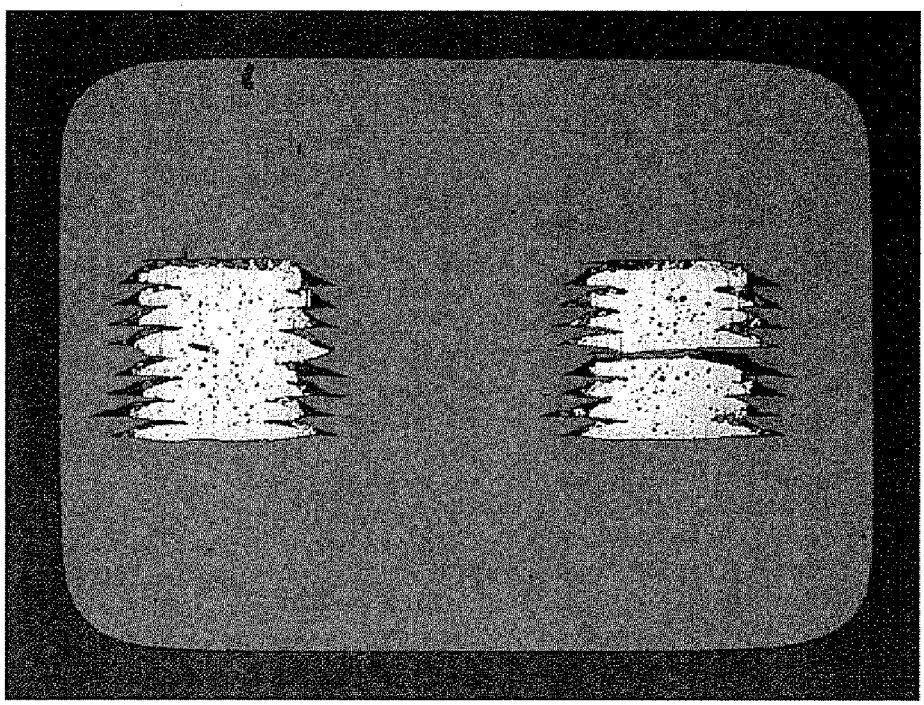
FIG. 9B is an image of a four-layer singly-wound multilayer inductor after firing.

Similarly, FIG. 9A is an image of a multilayer inductor prior to firing and FIG. 9B is an image of the multilayer inductor after firing. The multilayer inductor illustrated in FIGS. 9A and 9B has a structure in which two coil wiring lines are provided, each of which is constituted by four coil conductor layers, and in which the two coil wiring lines are connected in series with each other, that is, the multilayer inductor has a four-layer singly-wound structure. As illustrated in FIGS. 9A and 9B, the burn-away material is fired and the hollow portions are formed.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A multilayer inductor comprising:

an element body formed by stacking magnetic layers in a stacking direction; and a coil that is provided inside the element body and wound in a substantially helical shape, the coil being formed by stacking in the stacking direction a plurality of coil wiring lines that are wound in substantially planar shapes, and the coil wiring lines each including one or more coil conductor layers that are stacked in the stacking direction so as to be in surface contact with each other, wherein in a cross section, which is taken along the stacking direction, of at least one coil wiring line among the plurality of coil wiring lines, hollow portions exist between the magnetic layers and width-direction side surfaces of the one or more coil conductor layers, an upper surface of a first coil conductor layer, and a lower surface of at least one coil conductor layer among second and subsequent coil conductor layers, wherein in the at least one coil wiring line, a maximum width of the second and subsequent coil conductor layers is smaller than a maximum width of a lowermost coil conductor layer.

2. The multilayer inductor according to claim 1, wherein two or more of the coil wiring lines are electrically connected in parallel with each other.

3. The multilayer inductor according to claim 2, wherein among the two or more coil wiring lines that are electrically connected in parallel with each other, the number of coil conductor layers forming at least one coil wiring line is different from the number of coil conductor layers forming another coil wiring line.

* * * * *